US009016473B2

(12) United States Patent
Tamarindo

(10) Patent No.: US 9,016,473 B2
(45) Date of Patent: Apr. 28, 2015

(54) CAP FOR CONTAINERS

(75) Inventor: Stefano Tamarindo, Alessandria (IT)

(73) Assignee: Guala Pack S.p.A., Castellazzo Bormida (IT)

( * ) Notice: Subject to any disclaimer, the term of this patent is extended or adjusted under 35 U.S.C. 154(b) by 162 days.

(21) Appl. No.: 13/399,118

(22) Filed: Feb. 17, 2012

(65) Prior Publication Data

US 2012/0211460 A1 Aug. 23, 2012

(30) Foreign Application Priority Data

Feb. 18, 2011 (IT) ..... BS2011A0015

(51) Int. Cl.

| | |
|---|---|
| ***B65D 85/62*** | (2006.01) |
| ***B65D 51/24*** | (2006.01) |
| ***B65D 41/04*** | (2006.01) |
| ***B65D 81/36*** | (2006.01) |

(52) U.S. Cl.

CPC ..... *B65D 51/24* (2013.01); *B65D 41/0485* (2013.01); *B65D 81/361* (2013.01); *B65D 2213/00* (2013.01)

(58) Field of Classification Search

USPC ..... 215/329, 228; 220/23.2, 23.4, 380, 781; 446/122; 206/508

See application file for complete search history.

(56) References Cited

U.S. PATENT DOCUMENTS

| | | | | |
|---|---|---|---|---|
| 3,442,044 | A * | 5/1969 | Quercetti | 446/124 |
| 3,713,247 | A * | 1/1973 | Parrilla | 446/71 |
| 4,275,815 | A * | 6/1981 | Davis | 206/508 |
| 5,307,949 | A * | 5/1994 | Von Holdt, Jr. | 220/276 |
| 5,361,919 | A | 11/1994 | Hull et al. | |
| 5,791,509 | A * | 8/1998 | Rush et al. | 220/781 |
| 5,915,576 | A * | 6/1999 | Robinson | 215/216 |
| 6,296,541 | B1 | 10/2001 | Bezalel et al. | |
| 6,811,047 | B1 * | 11/2004 | Hicks et al. | 215/305 |
| 7,694,485 | B1 * | 4/2010 | Siener | 52/590.2 |
| 2001/0047994 | A1 * | 12/2001 | von Holdt, Jr. | 220/276 |
| 2007/0029325 | A1 * | 2/2007 | Herold | 220/288 |
| 2008/0078760 | A1 * | 4/2008 | Auer et al. | 219/735 |
| 2008/0087625 | A1 | 4/2008 | Kumata et al. | |
| 2009/0229481 | A1 * | 9/2009 | Patterson | 101/333 |
| 2010/0320168 | A1 * | 12/2010 | Bull | 215/219 |

FOREIGN PATENT DOCUMENTS

| | | | |
|---|---|---|---|
| CH | 642321 | A5 | 4/1984 |
| GB | 2410493 | | 8/2005 |
| WO | WO-9948582 | A1 | 9/1999 |
| WO | WO-9967151 | A1 | 12/1999 |
| WO | WO-2008050361 | A1 | 5/2008 |

OTHER PUBLICATIONS

Rapporto di Ricerca (Italian Search Report) mailed Oct. 10, 2011 for IT BS20110015.

* cited by examiner

*Primary Examiner* — Jeffrey Allen
(74) *Attorney, Agent, or Firm* — Harness, Dickey & Pierce, P.L.C.

(57) ABSTRACT

A plastic cap for a container, such as a bottle or flexible package, in particular for liquid foods for children, comprising projecting ribs for attaching to a similar, laterally adjacent cap and axial teeth for attaching to a similar axially overlapping cap.

18 Claims, 5 Drawing Sheets

CAP FOR CONTAINERS

CROSS-REFERENCE TO RELATED APPLICATIONS

This application claims the benefit and priority of Italian Patent Application No. BS2011A000015 filed Feb. 18, 2011. The entire disclosure of the above application is incorporated herein by reference.

FIELD

The present invention relates to a plastic cap for containers, in particular a cap for containers of liquid foods, for example, for bottles or flexible packages, especially for children, such as fruit juices and the like.

BACKGROUND

This section provides background information related to the present disclosure which is not necessarily prior art.

Containers having a closure member or a cap are known in the art. Improvements in caps for closing a container, especially containers for children, may be desirable.

SUMMARY

This section provides a general summary of the disclosure, and is not a comprehensive disclosure of its full scope or all of its features.

The purpose of the present invention is to catch the attention and incentivize the purchase of a bottle or container, especially in the eyes of a child, in that the relative cap, once separated from the bottle, can be used as a toy.

Such purpose is achieved by a cap for a container, in particular for liquid foods, such as orange juice and other similar drinks, comprising attachment means suitable to mechanically attach the cap in a releasable manner to at least one further similar cap, wherein the attachment means comprise axial attachment means with the further cap which is axially overlapping the previous cap, and wherein the axial attachment means comprise at least one tooth axially projecting, the tooth is suitable to engage with a skirt of the further overlapping cap.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
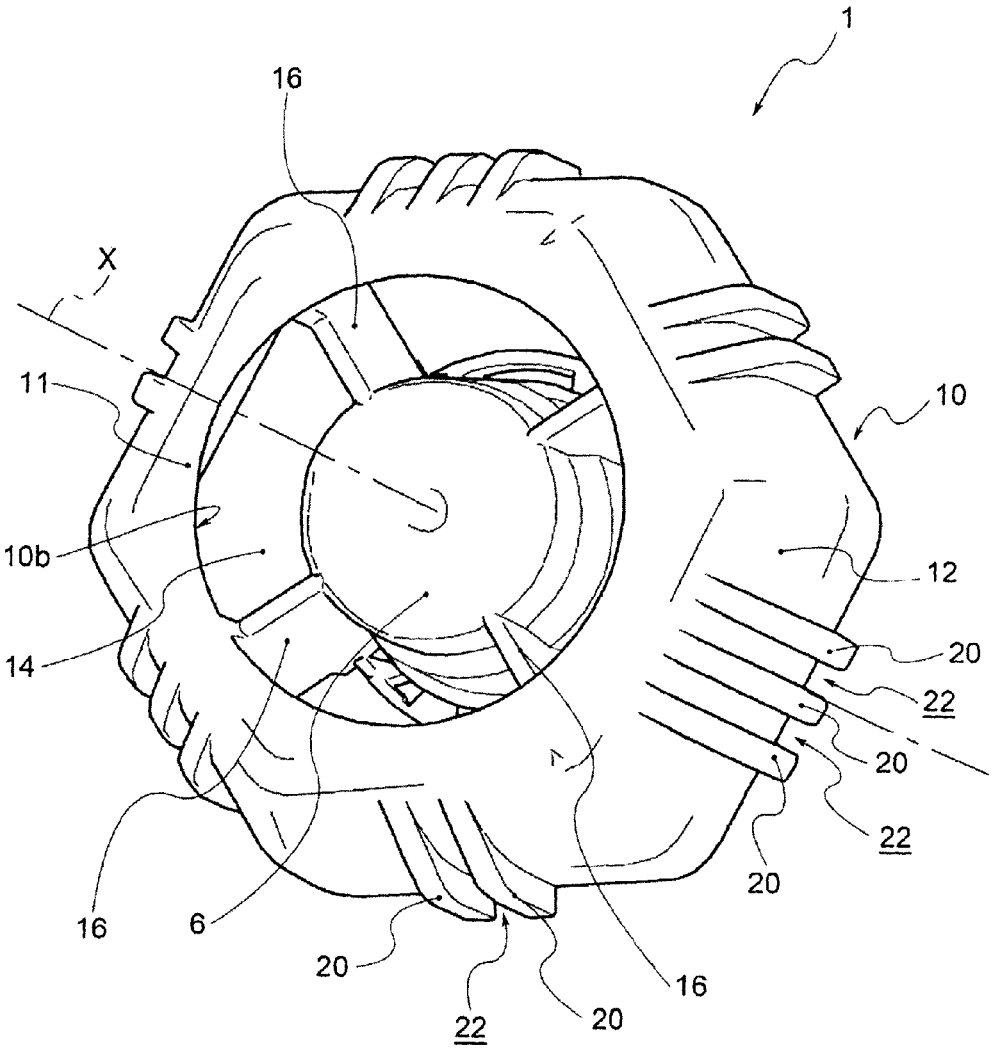
FIG. 1 shows a cap according to the present invention, according to one embodiment.
Figure 2:
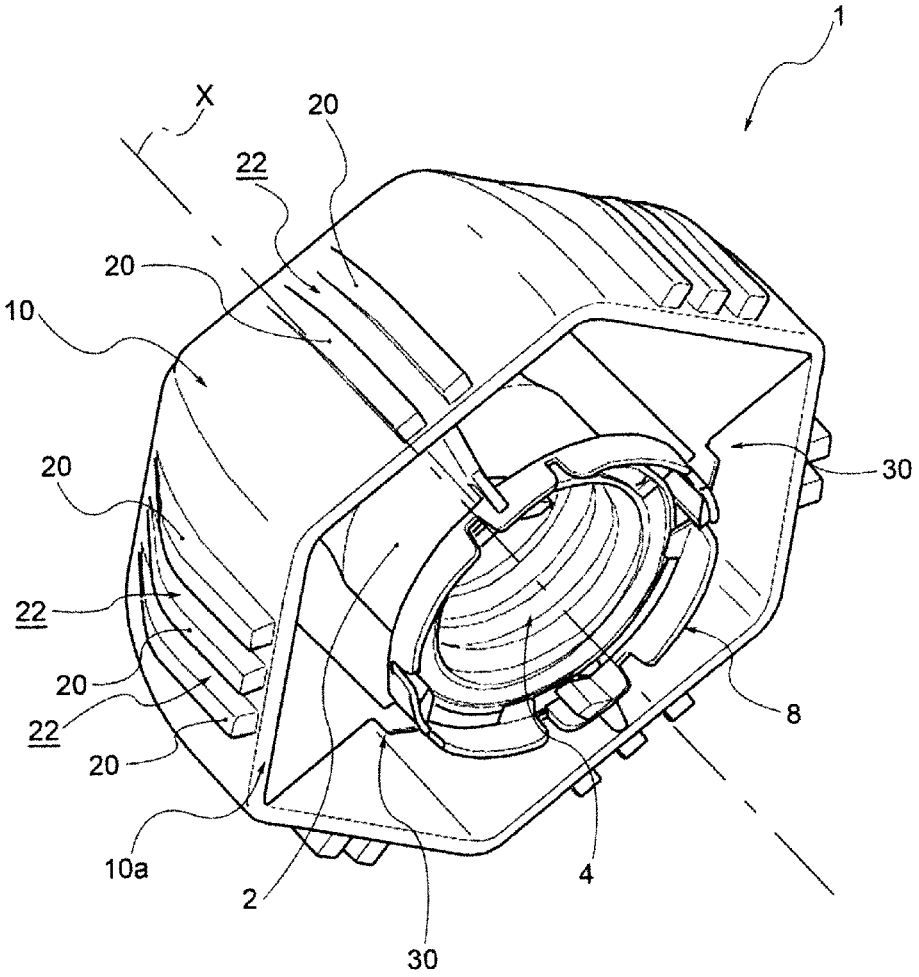
FIG. 2 shows the cap in FIG. 1, according to another view.
Figure 3:
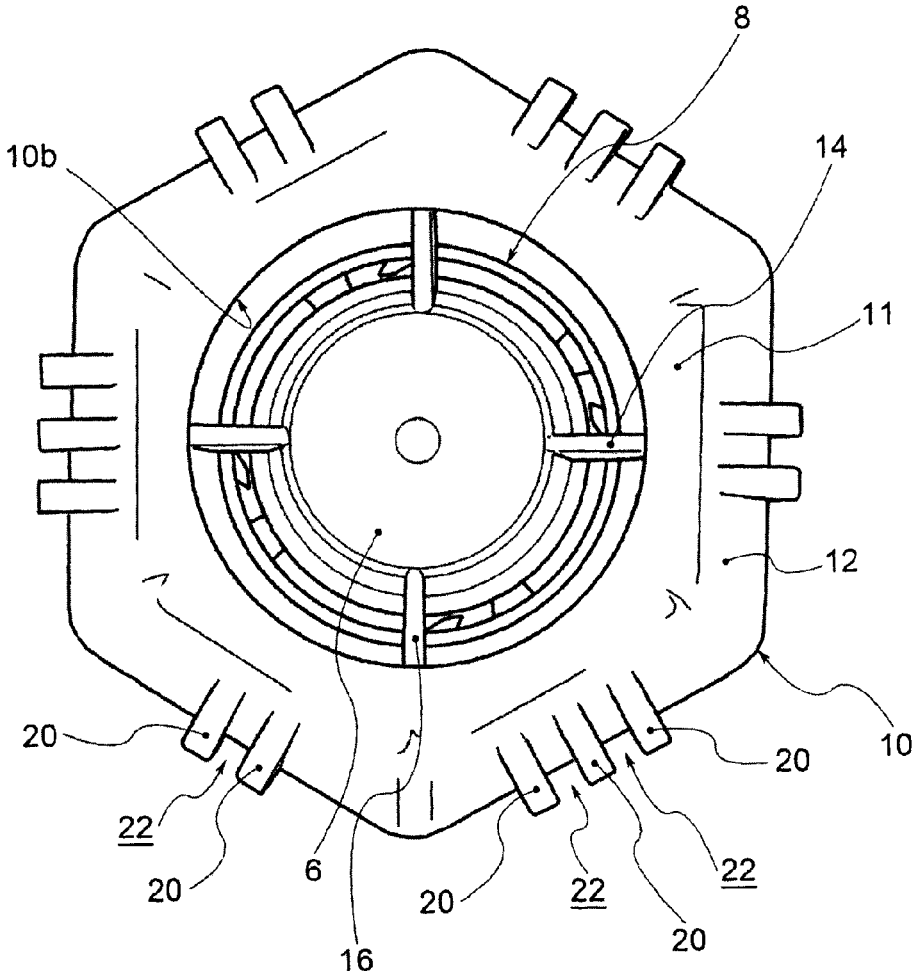
FIG. 3 shows a ground view of the cap in FIG. 1.
Figure 4:
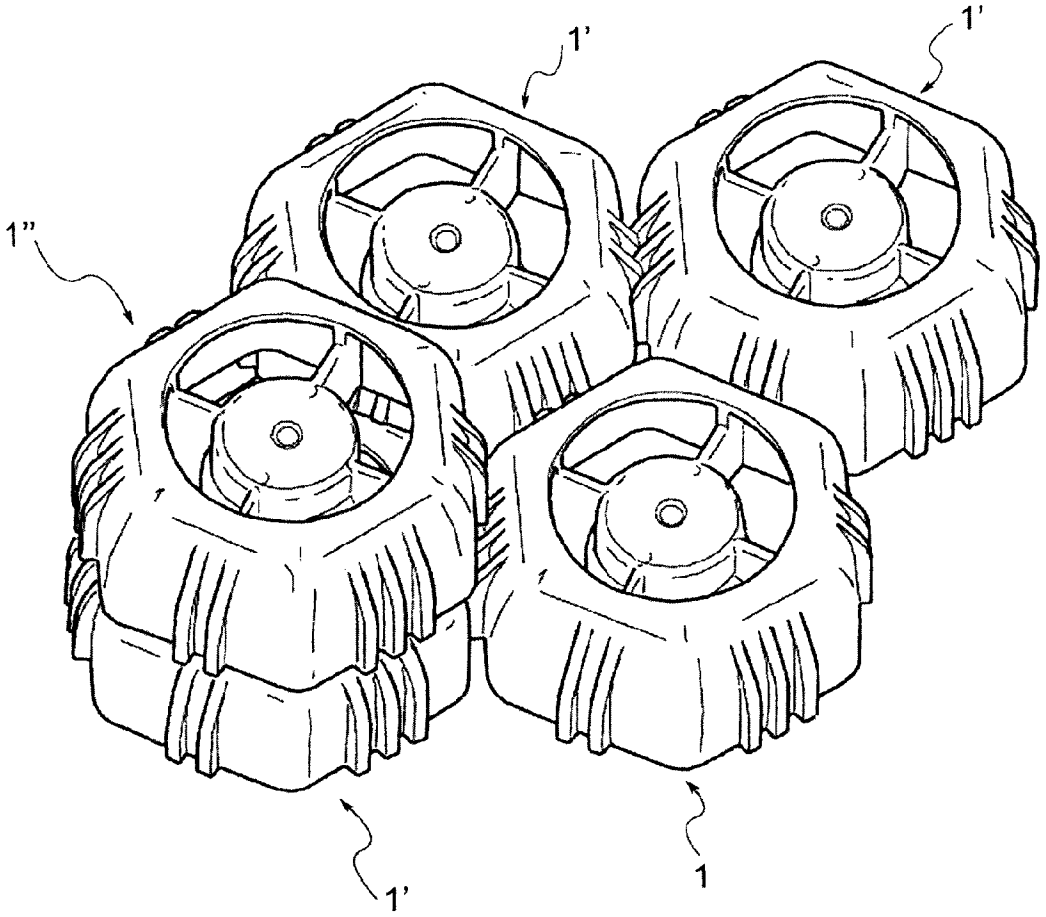
FIG. 4 shows a group of caps according to FIG. 1, laterally engaged with each other.
Figure 5:
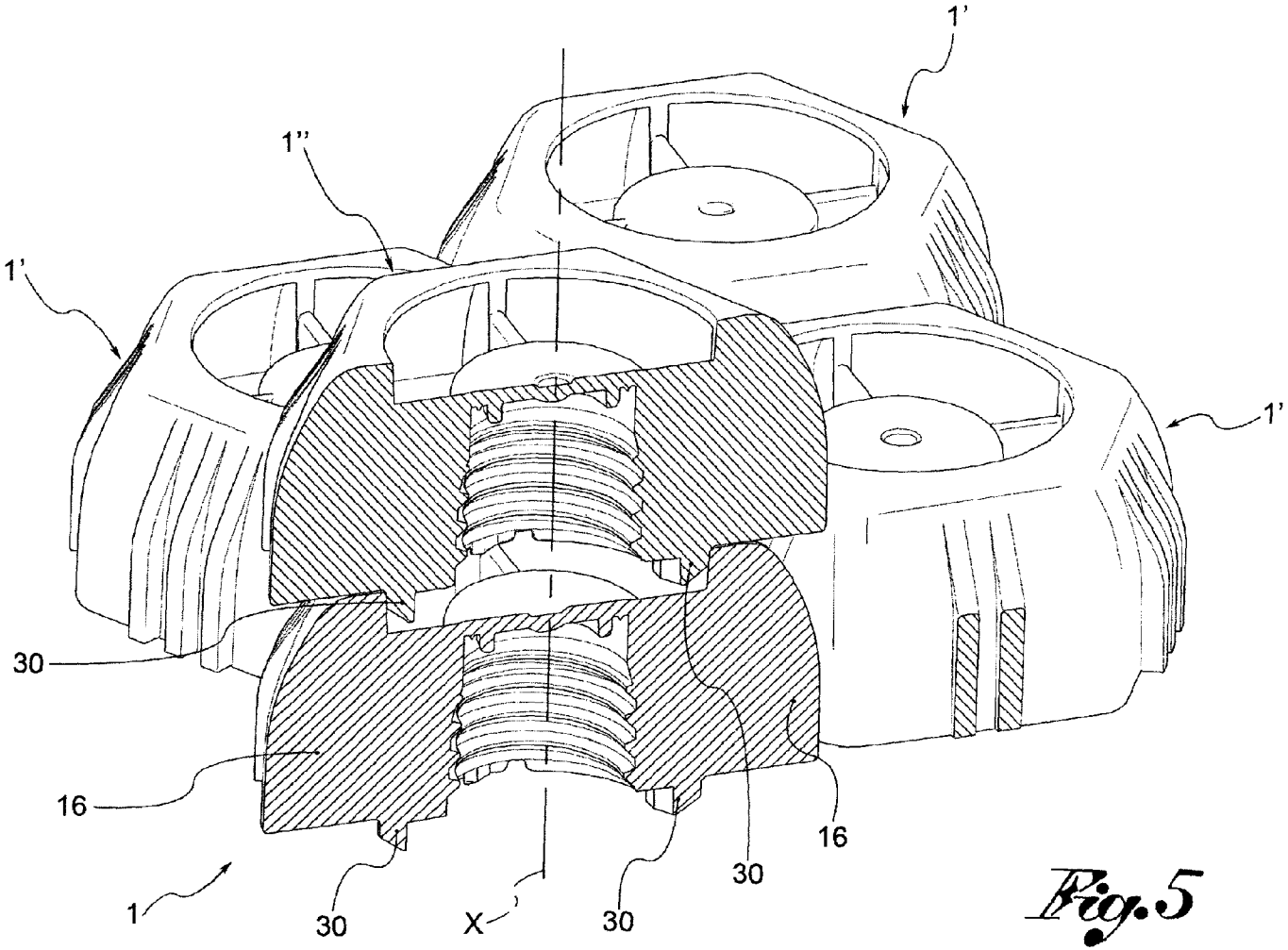
FIG. 5 shows a group of caps according to FIG. 1, laterally engaged and overlapping each other, partially in cross-section.

Example embodiments will now be described more fully with reference to the accompanying drawings.

With reference to the appended drawings, reference numeral 1 globally denotes a cap, preferably made of plastic, for containers of liquids, especially for children, such as fruit juices and other drinks.

The cap 1 comprises a central body 2, which extends along a central axis X.

The central body 2 is preferably a cylindrical shape on the outside and is provided with a threading 4 on the inside for screwing to the neck of the container or to a straw of a flexible package.

The central body is closed on the top by a base 6.

Preferably moreover, the central body comprises a guarantee seal 8 suitable for breaking when the cap is unscrewed from the container, for example positioned at the lower end of the central body 2, on the side opposite the base 6.

The construction and functional details of the guarantee seal 8 are described, for example, in the International Application WO 2008/050361 in the Applicant's name, incorporated herein by reference.

The cap 1 further comprises an annular skirt 10 which extends around the central axis, outside the central body 2, surrounding it annularly.

Preferably the skirt 10 is made from a continuous wall, having a lower free edge 10*a* and an upper free edge 10*b*, at the base 6 of the central body 2.

According to a preferred embodiment, an imaginary plane orthogonal to the central axis X is defined for the cap 1, a top surface 11 defining the top of the skirt 10 lying on the plane.

The upper free edge 10*b* preferably presents itself as a circumference which defines an aperture 14 in the top surface 11.

Preferably the skirt 10 comprises a plurality of sides 12 which succeed in annular series around the central body, connecting to each other, preferably with rounded edges.

The series of the sides preferably forms a polygonal shape, for example hexagonal. As a result, the lower free edge 10*a* is a polygonal shape, for example hexagonal.

Preferably moreover, from the lower free edge 10*a* to the upper free edge 10*b*, the sides 12 are arched, convex towards the outside.

The central body 2 is joined to the skirt 10.

For example, the cap 1 comprises a plurality of tabs 16 projecting radially outwards from the central body 2, which join the central body to the skirt 10.

Preferably the tabs 16 are four in number, angularly equidistant.

The skirt is radially spaced from the central body, so that, thanks to the angularly spaced tabs, a passage open to passage of the air is created to prevent suffocation accidents due for example to the accidental swallowing of the cap by a child.

The cap 1 comprises releasable lateral attachment means suitable for laterally attaching a first cap 1 with a further similar cap 1', in a releasable manner. The lateral means of attachment are suitable, in particular, for attaching the skirt 10 of the first cap 1 to the skirt of the second cap 1' alongside it laterally.

According to a preferred embodiment, the lateral attachment means are snap or interference operated.

For example, the lateral attachment means comprise a plurality of ribs 20 projecting outwards from the same side 12 of the skirt 10 of the first cap 1, in such a way that between two adjacent ribs 20 a seat 22 is formed for a rib projecting from the skirt of the further cap 1'.

Preferably the ribs 20 on the same side 12 are parallel to each other.

Preferably the rib 20 is of variable thickness from the lower free edge 10*a* towards the upper free edge 10*b*, for example of decreasing thickness, so as to form an arched outer surface without any sharp corners.

Preferably the adjacent sides 12 of the same cap 1 have a different number of ribs so as to engage with each other.

For example, according to a preferred embodiment, sides 12 with three or four ribs alternate annularly.

This way the two further ribs of the further cap 1' can be housed in the two seats 22 between the three ribs 20 of the first cap 1.

In other words, the ribs are divided in annularly separate groups, wherein one group of ribs contains a different number of ribs to the adjacent group.

Preferably moreover, the cap 1 comprises releasable axial attachment means, suitable for attaching a first cap 1 to a further similar cap 1", axially overlapping the first, in a releasable manner.

Preferably the axial means of attachment are suitable for attaching the tabs 16 of the first cap 1 to the skirt of the further cap 1".

According to a preferred embodiment, the axial attachment means are snap or interference operated.

For example, the axial attachment means comprise at least one tooth 30 projecting axially from the tab 16.

Preferably two teeth 30 projecting from diametrically opposite tabs 16 are provided.

In one embodiment, four teeth 30 projecting from respective tabs are provided.

The two teeth 30 are suitable for engaging by interference with the skirt of the further cap 1", inserting themselves in the upper free edge 10*b* of the skirt.

Preferably the tooth 30 has an inclined outer surface, which acts as a guide to the insertion of the tooth in the upper free edge 10*a*.

According to the invention therefore, the cap 1 comprises attachment means suitable for mechanically attaching the cap 1 in a releasable manner to at least one further similar cap 1', 1".

Preferably moreover, the cap is made in one piece in plastic material, for example by moulding.

Innovatively, the cap according to the present invention makes a container or bottle eye-catching, especially in the eyes of a child, in that the caps can be used as a toy by connecting them together.

It is clear that a person skilled in the art may make modifications to the cap described above so as to satisfy contingent requirements.

For example, according to one embodiment variation (not shown), the skirt comprises a plurality of separate portions which succeed each other annularly around the central body.

According to a further embodiment variation, the skirt has a circular or elliptical lower free edge.

According to yet a further embodiment, the skirt is the shape of a spherical cap.

For example, moreover, according to one embodiment variation, the ribs are convergent or divergent to/from each other.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cap for a container, in particular for liquid foods, such as orange juice and other similar drinks, comprising:

attachment means suitable to mechanically attach the cap in a releasable manner to at least one further similar cap, wherein the attachment means comprise axial attachment means with the further cap which is axially overlapping the previous cap, and wherein the axial attachment means comprise at least one axially projecting tooth, the tooth is suitable to engage with a skirt of the further similar cap, and further comprising, a central body having an axial extension, closed by a base at a top, and provided with a threading on the inside suitable for connection with the container;

wherein the skirt which surrounds the central body is annular and has a top surface, joined to the central body;

wherein the skirt is radially spaced from the central body to form a passage open to passage of air at least by the skirt having an upper free edge which defines the passage in the top surface and the skirt has a lower free edge, at the lower end of the central body on the side opposite the base.

2. The cap according to claim 1, wherein the skirt has a main axis, and wherein the skirt comprises a lateral attachment means with the skirt of the further cap laterally attachable to the previous cap.

3. The cap according to claim 2, wherein the lateral attachment means comprises a first plurality of spaced ribs projecting from the skirt, forming respective seats between each other, suitable to receive a second plurality of respective ribs of the further similar cap.

4. The cap according to claim 3, wherein the first plurality of ribs are divided in annularly separate groups, wherein a first group of ribs contains a different number of ribs to a second adjacent group.

5. The cap according to claim 4, wherein the first group of ribs comprises two or three ribs.

6. The cap according to claim 2, wherein the skirt is formed in a polygonal shape by means of a series of sides.

7. The cap according to claim 6, wherein the ribs are divided annularly into first and second separate groups, wherein the first group of ribs contains a different number of ribs from the second group, and wherein one of the first or second groups of ribs projects from one of the sides.

8. The cap according to claim 3, wherein the ribs have an axial pattern.

9. The cap according to claim 8, wherein the ribs are parallel to each other.

10. The cap according to claim 3, wherein the ribs decrease in thickness axially, from a lower free edge towards an upper free edge of the skirt.

11. The cap according to claim 3, wherein the cap comprises angularly spaced tabs which extend radially to join the central body to the skirt.

12. The cap according to claim 11, wherein the ribs decrease in thickness axially, from the lower free edge towards the upper free edge of the skirt, and wherein the passage surmounts the central body, delimited by the upper free edge, wherein the at least one tooth is configured to engage the upper free edge.

13. The cap according to claim 12, wherein the at least one tooth has an inclined guide surface for insertion on the skirt.

14. The cap according to claim 1, comprising a guarantee seal.

15. The cap according to claim 1, made in a single piece in plastic material.

16. An assembly comprising a plurality of caps made according to claim 1, positioned alongside each other axially overlapping and attached to each other in a releasable manner.

17. The assembly according to claim 16, wherein a first passage defined by a first cap is in communication with second passage defined by a second cap.

18. A cap for a container, comprising:

a central body extending along a central axis and having a cylindrical shape with a lower end that is open and a top that is closed by a base, the central body including internal threads configured to engage external threads on the neck of the container;

an annular skirt that extends around the central axis to surround the central body and is radially spaced from the central body, the skirt including a continuous wall having a lower free edge adjacent to the lower end of the central body and an upper free edge adjacent to the base of the central body; and a plurality of tabs projecting radially outward from the central body and joining the central body to the skirt, wherein the skirt is radially spaced from the central body to form a passage open to passage of air at least by the skirt having a top surface with the upper free edge that defines the passage for the passage of air and the skirt has the lower free edge, at the lower end of the central body on the side opposite the base; and a plurality of teeth projecting axially from the tabs along the central axis of the central body in a direction away from the base of the central body, the teeth being configured to engage by interference with the upper free edge of a skirt of a similar cap to connect the two caps together.

* * * * *